US007694357B2

(12) United States Patent
Alvite

(10) Patent No.: US 7,694,357 B2
(45) Date of Patent: Apr. 13, 2010

(54) SAFETY BAR FOR A BATHTUB

(76) Inventor: Joanne Alvite, 213 Atlantic Ave., Massapequa Park, NY (US) 11762

( * ) Notice: Subject to any disclaimer, the term of this patent is extended or adjusted under 35 U.S.C. 154(b) by 1152 days.

(21) Appl. No.: 11/303,314

(22) Filed: Dec. 16, 2005

(65) Prior Publication Data

US 2007/0006379 A1 Jan. 11, 2007

Related U.S. Application Data

(60) Provisional application No. 60/697,052, filed on Jul. 6, 2005.

(51) Int. Cl.
*A47K 3/024* (2006.01)

(52) U.S. Cl. ..... 4/576.1; 4/571.1

(58) Field of Classification Search ..... 4/573.1, 4/576.1, 577.1, 589, 611; 248/200.1; 211/105.1–105.6, 211/16, 6, 123
See application file for complete search history.

(56) References Cited

U.S. PATENT DOCUMENTS

| | | | | | |
|---|---|---|---|---|---|
| 457,977 | A * | 8/1891 | Wilkening | 211/123 |
| 2,199,851 | A * | 5/1940 | Culver | 248/264 |
| 2,736,904 | A | 3/1956 | Suggs | |
| 2,815,513 | A | 12/1957 | Tilson et al. | |
| 3,062,381 | A * | 11/1962 | Maiden | 211/105.6 |
| 3,713,179 | A | 1/1973 | Dubiel | |
| 3,955,239 | A | 5/1976 | Grossman | |
| 4,473,225 | A * | 9/1984 | Miller | 482/40 |
| 4,783,998 | A | 11/1988 | Sander | |
| 5,231,707 | A | 8/1993 | Ashley et al. | |
| 5,249,315 | A | 10/1993 | Moylan | |
| 5,365,619 | A | 11/1994 | Solomon | |
| 5,771,505 | A | 6/1998 | Reynolds | |
| 6,381,771 | B1 | 5/2002 | Kelly | |
| 6,507,960 | B1 | 1/2003 | Kelly | |
| 6,701,543 | B1 | 3/2004 | Haq | |
| 6,845,955 | B1 * | 1/2005 | Hsu | 248/200.1 |

FOREIGN PATENT DOCUMENTS

| | | |
|---|---|---|
| DE | 274 260 | 12/1989 |
| EP | 1 004 009 | 10/2001 |

* cited by examiner

*Primary Examiner*—Gregory L Huson
*Assistant Examiner*—Karen Younkins
(74) *Attorney, Agent, or Firm*—Collard & Roe, P.C.

(57) ABSTRACT

The invention relates to a safety bar for a bathtub to help prevent children from falling into a tub. The bar can be moved from a lower position to an upper position to form a barrier to keep children out of a tub. Alternatively, the device when it is in its extended position can be used to provide an additional support for a user when sitting in a tub, so that the user does not slide in the tub.

8 Claims, 4 Drawing Sheets

SAFETY BAR FOR A BATHTUB

CROSS REFERENCE TO RELATED APPLICATIONS

This application claims priority under 35 U.S.C. §119(e)(i) the benefit of U.S. Provisional Application Ser. No. 60/697,052 filed on Jul. 6, 2005 entitled "BATHTUB SAFETY BAR FOR CHILDREN" which is incorporated by reference herein.

BACKGROUND OF THE INVENTION

The invention relates to a bathtub safety bar which can be movable or adjustable from a first position to a second position. Other bathtub safety bars are known in the art. For example, U.S. Pat. No. 6,381,771 issued on May 7, 2002 to Kelly discloses a bath safety fixture; U.S. Pat. No. 6,507,960 issued on Jan. 21, 2003 to Kelly also discloses a bath safety fixture wherein the disclosures of which are hereby incorporated herein by reference.

Other bathtub safety devices are known such as U.S. Pat. Nos. 5,365,619, to Solomon; 3,713,179 to Dubiel; 2,736,904 to Suggs; 5,249,315 to Moylan; 2,815,513 to Tilson et al; 5,231,707 to Ashley et al; 3,955,239 to Grossman; 5,771,505 to Reynolds; and 6,701,543 to Haq, wherein the disclosures of these above referenced patents are hereby incorporated herein by reference.

SUMMARY OF THE INVENTION

The invention relates to a bathtub safety bar that can include a bar, and at least two side supports. Each side support can include a housing and a movable support block coupled to the housing and a spring disposed inside of the housing and coupled to the moveable support block. This spring can be used to bias the support block in an open position which either keeps the bar in a downward position or it can be used to support the bar in an upward position.

The support blocks can be in the form of a wedge that allows a connection element coupled to the bar to slide over the support blocks from the lower position to the upper position. The connection element can be in the form of a slidable block which slides on a track coupled to the housing.

The bar can be made from any known material and can be, for example, made from metal or plastic. The housing, the connection element, and the support blocks can also be made from any known material and also can be made from, for example, metal, or plastic. In at least one embodiment the connection element and the support blocks are made from a polymer or plastic material that has a relatively low coefficient of friction which allows the connection element to slide over the support block from a first position to a second position.

BRIEF DESCRIPTION OF THE DRAWINGS

Other objects and features of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
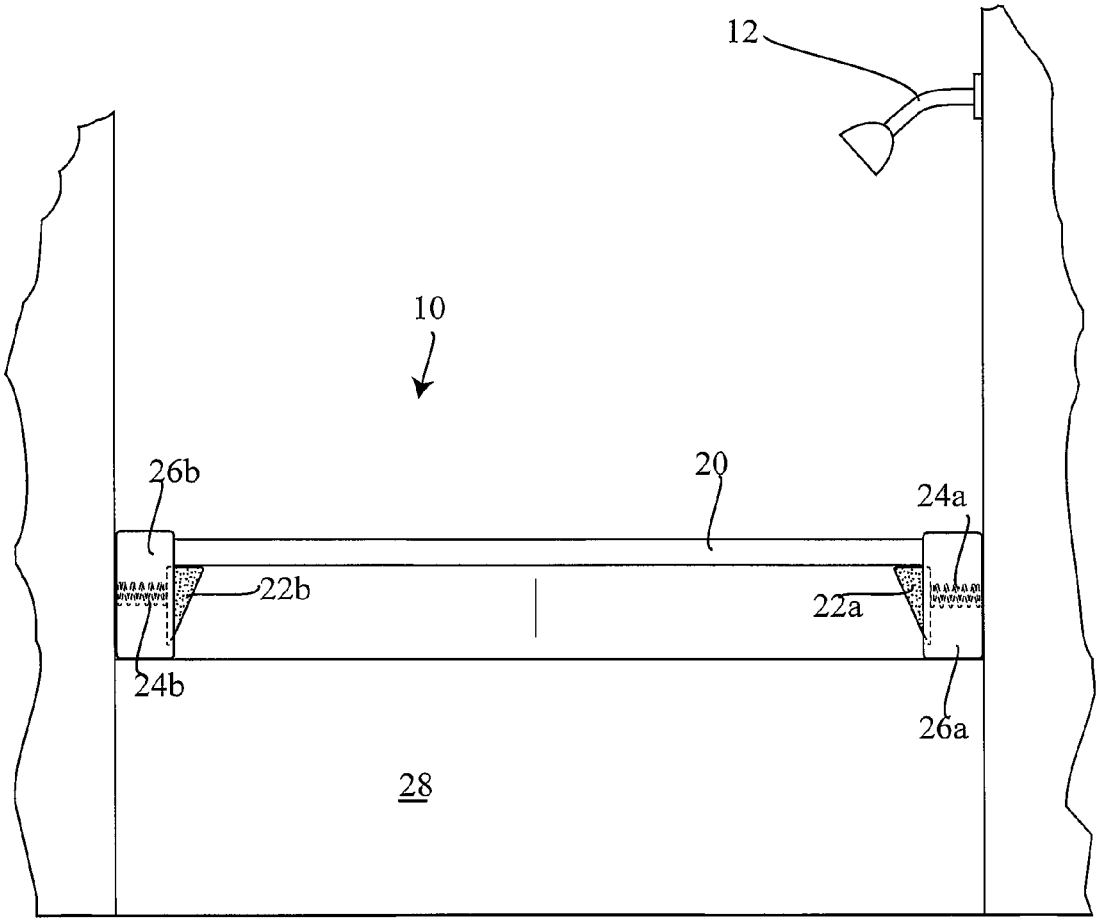
FIG. 1 is a side view of the first embodiment of the invention.

Turning now in detail to the drawings, FIG. 1 is a side view of the first embodiment of the invention. In this first side view, there is shown the device 10 which includes a bar 20, side blocks 26*a* and 26*b* and associated springs 24*a* and 24*b* disposed inside of side blocks 26*a* an 26*b*. There are also supports 22*a* and 22*b* which are disposed inside of blocks 26*a* and 26*b*, wherein these supports 22*a* and 22*b* are spring loaded or biased in an open position by associated springs 24*a* and 24*b*. For example, inside of block 26*a* is spring 24*a* which presses against a back end of block or support 22*a* and presses block or support 22*a* out. Block or support 22*a* is hingedly coupled to block 26*a* at a bottom section 25*a* (See FIG. 2) and slidable at a top end 27*a*.

When bar 20 is in its raised position, bar 20 rests on a top surface 29*a* of support 22*a*. To lower bar 20 support 22*a* is pressed into block 26*a* against spring 24*a* so that upper end 27*a* extends inside of block or housing 26*a*. At this point bar 20 can then be lowered down.

Figure 2:
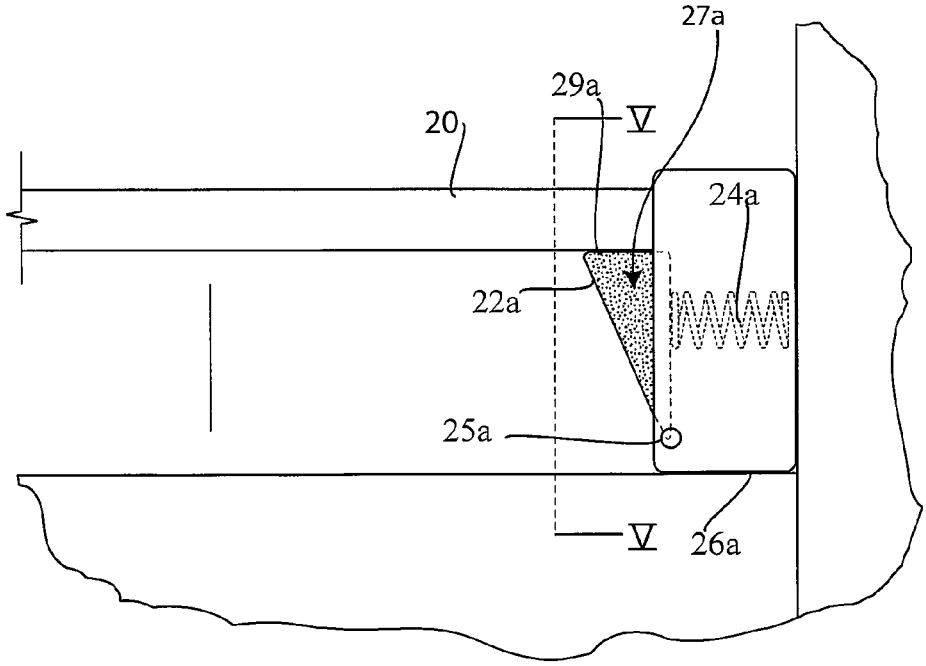
FIG. 2 is a close-up side view of the arm.

FIG. 2 is a close-up side view of the arm which shows top surface 29*a* on support block 22*a*. This view also shows that block 26*a* is coupled to both a side wall and a top of a bathtub.

Figure 3:
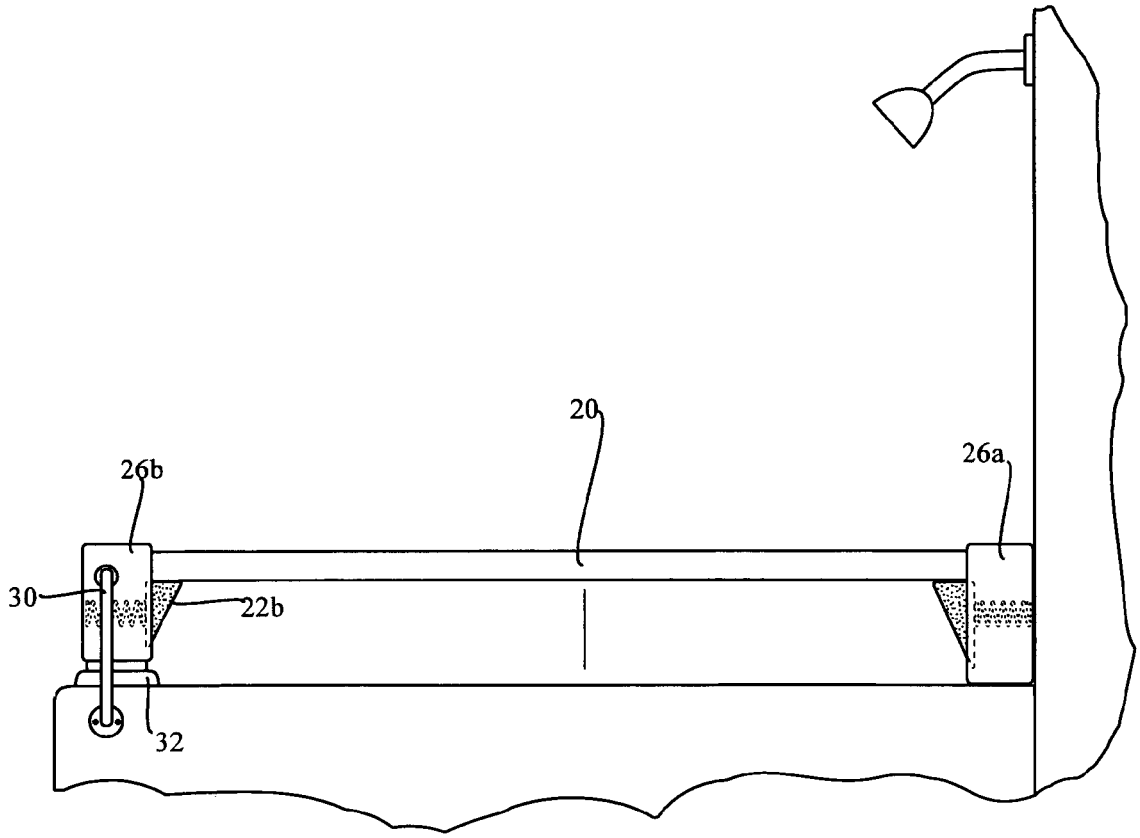
FIG. 3 is a side view of another embodiment of the invention.

FIG. 3 shows a side view of another embodiment of the invention. In this view, bar 20 is shown coupled to blocks 26*a* and 26*b* wherein block 26*b* is shown coupled in a free standing manner. Block 26*b* has a bottom connector section 32 which can be in the form of a permanent connection base that can be permanently coupled to the top of a bathtub via an adhesive such as caulk or any other known silicone based adhesive or it can be coupled to the top of the bathtub via a semi-permanent coupling element such as a suction cup.

Figure 4:
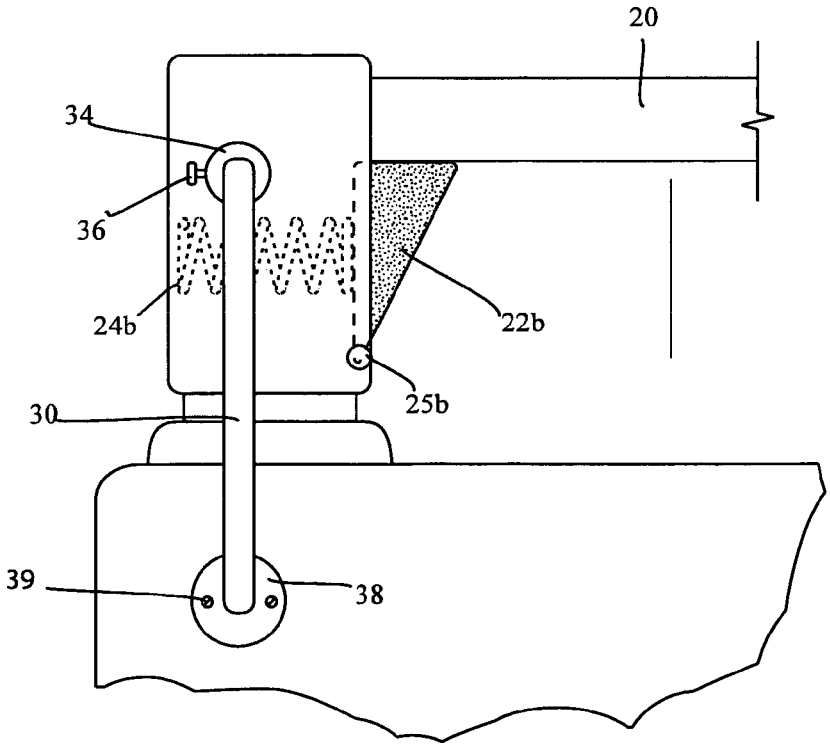
FIG. 4 is a close up side view of a section shown in FIG. 3.

FIG. 4 shows a close-up view of block 26*b*, wherein block 26*b* is coupled to tub with a lateral support bar 30. Lateral support bar 30 can be coupled to plate 38 which can be fixedly coupled to tub via screws or any known means. At a top end there is also another coupling bracket 34 which can receive support bar 30 as it couples into block 26*b*. This support bar 30 can be released from block 26*b* by pressing a lever or button 36 which releases bar 30 from bracket 34 and which then releases block 26*b* which allows block 26*b* to be released from the tub.

This view also shows that disposed inside of block 26*b* is the hinge connection 25*b* for support block 22*b*.

Figure 5:
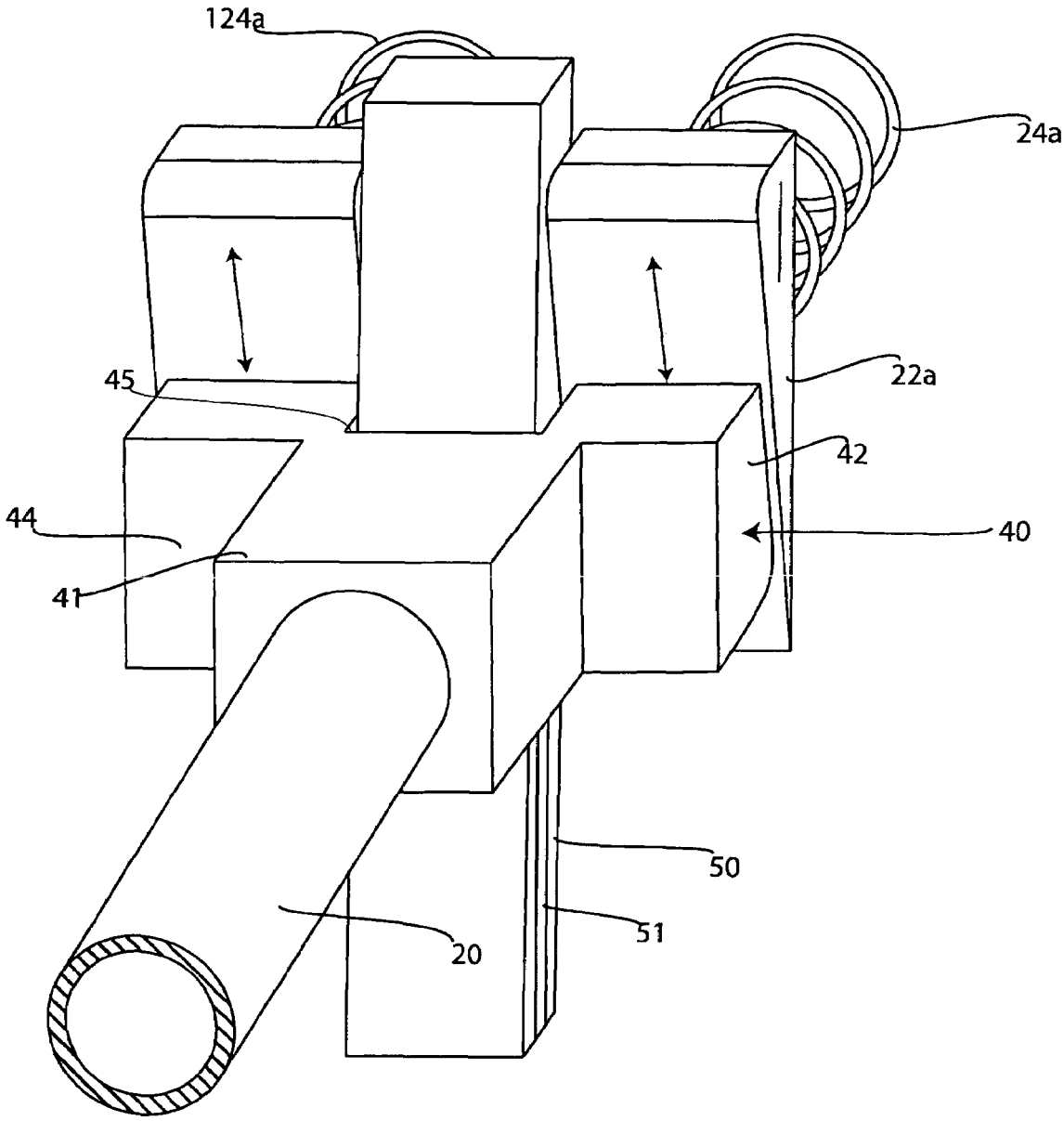
FIG. 5 is a perspective, cross sectional view of the section V-V shown in FIG. 2.

FIG. 5 shows a side perspective view of a connection of bar 20 to block 26*a* or 26*b* via a track 50 taken along the line V-V. Each block 26*a* or 26*b* has a track 50 which allows a slidable block 40 to slide thereon. Slidable block 40 is coupled to bar 20 in any known manner at a central block section 41, wherein this block includes wing blocks 42 and 44 and a central hole 45 for receiving track 50. Block 40 can be secured to track 50 in a vertically slidable manner via additional vertical track 51 disposed in track 50. This additional track can be used to lock block 40 from moving in a substantially horizontal manner while it is sliding up and down in a vertical manner.

Figure 6:
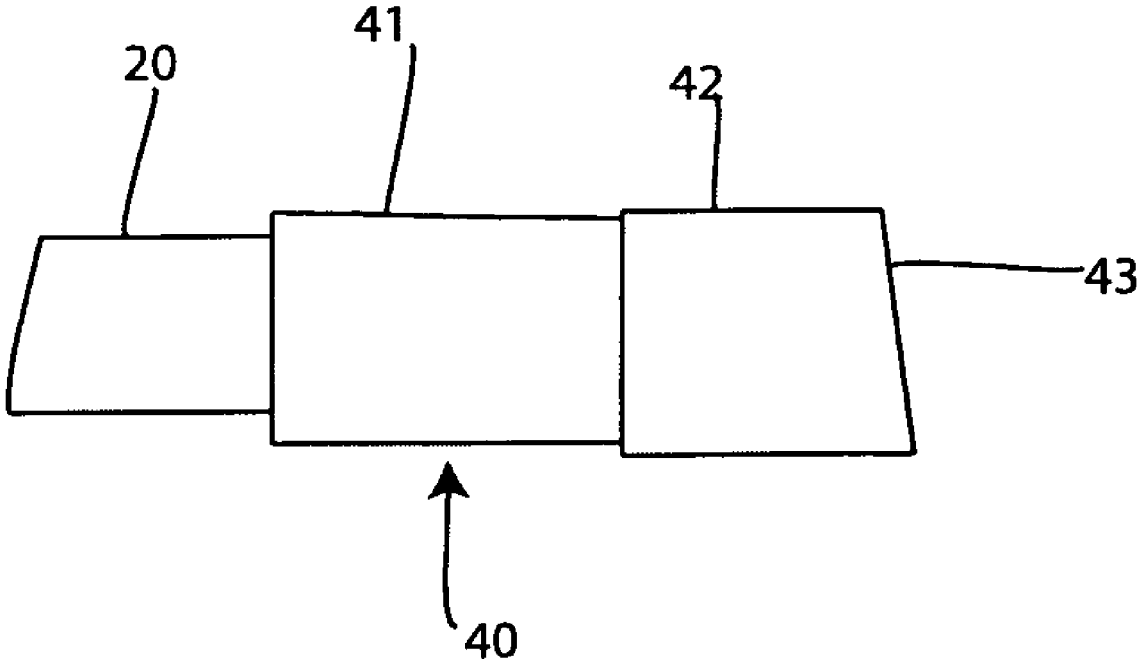
FIG. 6 is a side view of the connection block shown in FIG. 5.

FIG. 6 shows a side view of the device shown in FIG. 5. With this view there is shown a bar 20 which can be coupled to a central or center portion 41 of block 40. This block 40 also has wings 42 as disclosed above. The back face 43 of block 40 can be formed in an angled manner so that this back face slides easily against the surface of support blocks 22*a* and 22*b*.

This movable bar has been created so that users can adjust the bar from a lower position, adjacent to a top surface of a bathtub to an upper position. When bar 20 is in its upper position, it can be used to keep children out of a bathtub and also to help those in the bathtub in having a hand grip on the bar. Because the bar is easily movable from a first position to a second position it creates an easily adjustable bar system.

For example, for a user to raise the bar from a first lower position to an upper position, the user can simply pull bar 20 up. Block 40 would then slide across support blocks 22*a* and 22*b* with angled back face 43 sliding against a front face on support block 22*a* as shown in FIG. 5. During this time, block 40 can also be engaged in slot 51, 50 that block 40 slides in a substantially vertical manner. As bar 20 moves up, it presses against support blocks 22*a* and 22*b* causing blocks 22*a* and 22*b* to press in to their associated housings 26*a* and 26*b* by pressing against the associated springs 24*a* and 24*b*. Support blocks 22*a* and 22*b* would rotate about hinges or axles 25*a* and 25*b* so that the upper part of support blocks 22*a* and 22*b* would be pushed inside of housings 26*a* and 26*b*. Once the bar has reached its full height, support blocks 22*a* and 22*b* would snap back out away from housings 26*a* and 26*b* due to the spring forces placed on them by associated springs 24*a* and 24*b*.

At this upper position, support blocks 22*a* and 22*b* would be in their extended out position and would therefore support bar 20 and blocks 40 in the upper position. In this upper position block 40 would rest upon top surfaces 29*a* and 29*b* of support blocks 22*a* and 22*b*.

To lower bar 20, a user could press in a top section of blocks 22*a* and 22*b* to drive this top section back into the associated housings 26*a* and 26*b*. This pressing action would compress associated springs 24*a* and 24*b*.

Once support blocks 22*a* and 22*b* are pressed sufficiently inside their housings, block 40 including wings 42 would clear these support blocks and then slide down to a lower position as shown in FIG. 5.

The embodiment shown in FIG. 5 is simply one example of a design that can be used to allow the bar to slide up and down.

Other embodiments using slidable blocks are also possible for this invention. For example, bar 20 could slide on a track and be supported by any known support element in a single elevated position or in multiple levels or multiple positions above a tub.

Accordingly, while a few embodiments of the present invention have been shown and described, it is to be understood that many changes and modifications may be made thereunto without departing from the spirit and scope of the invention as defined in the appended claims.

What is claimed is:

1. A bathtub safety bar comprising:

a) a bar;

b) a first side support comprising:

i) a housing;

ii) a movable support block disposed inside of said housing;

iii) a spring disposed inside of said housing and coupled to said moveable support block; and iv) a track disposed in said housing wherein said bar is slidable on said track;

c) a second support comprising:

i) a housing;

ii) a movable support block disposed inside of said housing;

iii) a spring disposed inside of said housing and coupled to said moveable support block; and iv) substantially vertical a track disposed in said housing wherein said bar slides in a substantially vertical direction on said track wherein said bar is disposed between said supports and is supported at each end by said supports.

2. The device as in claim 1, wherein said first support is coupled to a wall on a first side and is also coupled to a top surface on a bathtub.

3. The device as in claim 1, wherein said second support is coupled to a top surface on a bathtub.

4. The device as in claim 1, wherein said second surface is coupled to a wall.

5. The device as in claim 1, wherein said movable support block is in the form of a block having a triangular cross section.

6. The device as in claim 5, wherein said movable support block has an upper surface for supporting the bar above a surface on a tub.

7. The device as in claim 1, wherein said support block having a triangular shaped cross-section is shaped as a wedge that allows said bar to slide over said support block from a bottom section to a top section with a top surface of said support block providing support.

8. The device as in claim 7, further comprising at least one hinge, wherein said support block is coupled to said housing via said at least one hinge.

* * * * *